United States Patent [19]

Thomas et al.

[11] 4,422,316

[45] Dec. 27, 1983

[54] KEY CASE

[76] Inventors: Richard D. Thomas, 5816 W. 55th St., Chicago, Ill. 60638; William R. Kjeldsen, 10352 S. Homan Ave., Oak Lawn, Ill. 60655

[21] Appl. No.: 283,995

[22] Filed: Jul. 16, 1981

[51] Int. Cl.[3] ..... A47G 29/10

[52] U.S. Cl. ..... 70/456 R; 70/457

[58] Field of Search ..... 70/456 R, 456 B, 457; 49/70; 242/107, 107.2; 16/137

[56] References Cited

U.S. PATENT DOCUMENTS

| | | | |
|---|---|---|---|
| 1,802,402 | 4/1931 | Best | 70/456 R |
| 3,640,108 | 2/1972 | Cairns | 70/456 R |

*Primary Examiner*—Robert L. Wolfe

*Attorney, Agent, or Firm*—Wallenstein, Wagner, Hattis, Strampel & Aubel

[57] ABSTRACT

This invention relates to the key case that is adapted to be attached to a fixed location on or adjacent a door that is attached to a casing by hinges and has a lock openable with a key. The key case has a sleeve for receiving the conventional hinge pin of an interleaved hinge so that the key case is located in a readily locatable position with respect to the door. The key case has a retracting mechanism with a flexible member attached thereto and the key attached to the free end thereof. Stop means are located within the key case and define a stored position for the key wherein a portion extends through an opening in the case to be gripped by a user and retracted and moved to the lock. The retracting mechanism automatically returns the key to the stored position whenever it is dropped or released.

5 Claims, 3 Drawing Figures

KEY CASE

DESCRIPTION

1. Technical Field

The present invention relates generally to a key case and, more specifically, to a key case adapted to be attached on or adjacent to a door, for maintaining a key for unlocking the door in a readily accessible position in the event of an emergency situation such as a fire, or, in non-emergency situations, in a position where the key will always be available and cannot intentionally, or inadvertently, be walked-away-with, so to speak.

2. Background Prior Art

Many locks which are now on the market, particularly those used on entry doors for added security in homes, apartments and other locations, require a key whenever the lock is to be locked or unlocked from either side of the door. In areas where internal security presents no problems, it has been customary to place the key for the lock adjacent the door in the event that the door needs to be opened from the inside. One of the most common spots for placing a key of this type is above the door on the trim of the door casing so that the door can be unlocked without searching for a key in another part of the residence. Another common storage spot for a key is a hook near the door.

In emergency situations, such as fire, especially a fire accompanied by heavy smoke, it is difficult for a person to locate a key stored on the door trim. Where a child is involved, even though the location of the key is known to the child, it may be impossible to reach the key. Even if the key is located, because of the panic which invariably occurs in such situations, there is always the possibility that the key will be dropped. Once the key has been dropped, it may never be located in time to save the occupants of the dwelling.

SUMMARY OF THE INVENTION

According to the present invention, a unique key case and attaching mechanism has been developed so that a key can be permanently stored adjacent a door lock and can readily be located by the occupant under substantially any conditions, even dense smoke. More specifically, the key case of the present invention is adapted for use with a conventional door that has a lock thereon and is attached to a door casing by a conventional hinge means such as a hinge having inter-leaving portions interconnected by a hinge pin and respectively secured on the door jamb and the door.

The key case of the present invention, in brief, desirably has a sleeve adjacent one end of one edge thereof with the remainder of the edge being contoured to engage the exposed interleaved portions of a door hinge so that the key case can be attached directly to the hinge, particularly, and preferably, to the lower hinge of the door, and become a permanent part therof. The key case advantageously is provided with a knockout hole to enable it to be mounted, if desired, on a wall adjacent to a door in a position where it would be concealed, such as behind a window drape, for example.

In a preferred embodiment, the key case includes a retracting mechanism attached at one end to a flexible member, such as a chain, cord or wire, which preferably is non-flammable, while the other end is attached to means for carrying a key to unlock the door lock. The flexible member is of sufficient length so that the key can be extracted from the key case and pulled a sufficient distance to unlock the door. In the event the key is dropped during an emergency situation, such as a fire where heavy smoke is present, the key will automatically return to the stored position, and the occupant, knowing the location of the stored position, can readily retrieve the key even under conditions where visibility is zero.

In a more specific embodiment, the key case includes a tension-spring mechanism of sufficient length to allow the key to be retracted at least five feet from the key case, and the key case has an opening along one edge thereof with guide means on each side thereof to guide the key to a stored position defined by stop means within the key case. In its stored position, only a small portion of the key is exposed for gripping by the occupant, and the retracting mechanism will always return the key to the same fixed, easily found location with respect to the door.

Wholly apart from the emergency aspects of the present invention, another important advantage thereof centers on the fact that, by being permanently attached to the door hinge, and by the key being securely attached to the flexible member, no one can intentionally or inadvertently walk away with it. The key will always be there in a readily accessible location. Also of importance is the fact that only a small portion of the key extends outwardly from the bottom of the key case, and that portion is pointed downwardly with relation to the vertical plane of the door. This arrangement effectively prevents an intruder, such as a burglar, from breaking a glass window in the upper part of a door, for example, and retrieving the key from the key case either by hand or with a tool.

BRIEF DESCRIPTION OF SEVERAL VIEWS OF DRAWINGS

DETAILED DESCRIPTION

Figure 1:
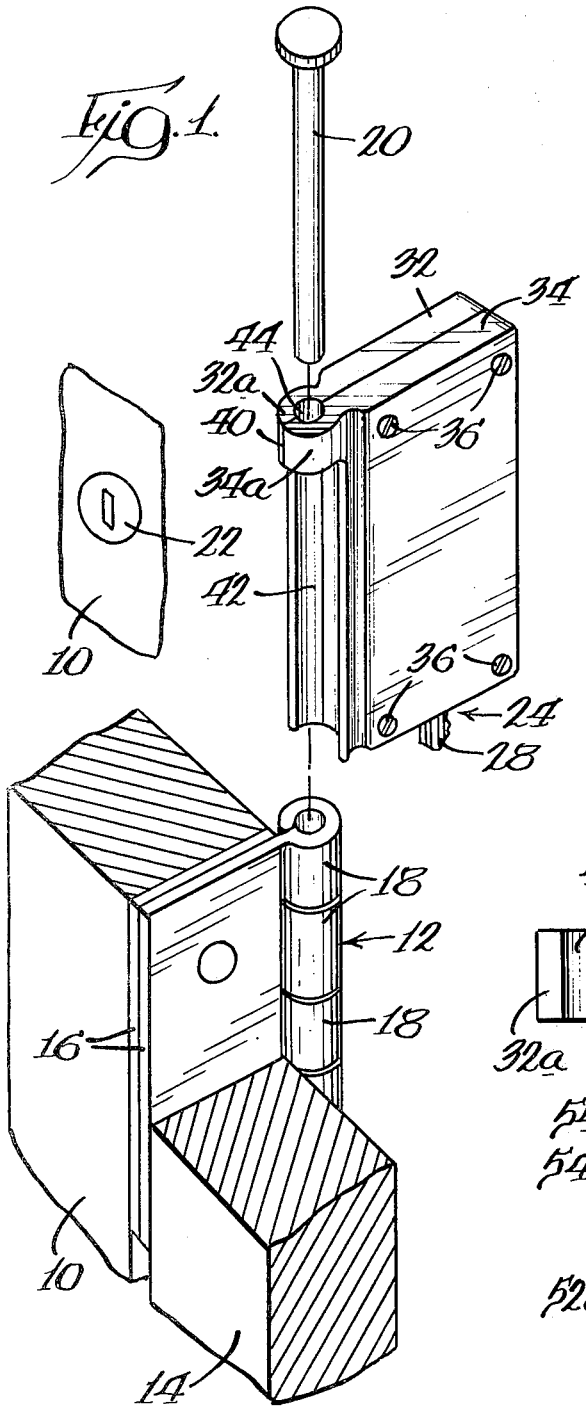
FIG. 1 is an exploded fragmentary perspective view of a door attached to a door casing by a conventional hinge with an embodiment of the key case of the present invention associated therewith.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Referring now, in greater detail to FIG. 1 of the drawings, the door, generally designated by reference numeral 10, is attached by a hinge means, generally designated by reference numeral 12, to a door casing 14. The standard hinge utilized in many door attachments includes a pair of plates 16 respectively attached to the door casing and the door with interleaved portions 18 on the respective plates that are interconnected by a hinge pin 20.

One edge of the door 10 is normally connected to the adjacent casing 14 through three hinges 12 that are vertically spaced from each other, while the opposite edge of the door has a latch mechanism and/or lock 22 which has a tumbler mechanism which is adapted to be operated by a key 24. Key 24 has a head 26 and a narrow tumbler operating portion or shank 28.

An opening in the opposite edge of the door case (not shown) has a recess for receiving the bolt of the lock 22.

As indicated above, many of the presently available locks, such as dead bolt locks, require a key to lock and unlock the door from either side. This, in the past, has created many problems, particularly when fires occur and the door is locked. Many lives are lost annually because the occupants of the premises do not have a key which is readily accessible for the door or the key cannot be readily located by the occupant.

According to the present invention, a key case has been devised which can be permanently attached to a door in close proximity to the lock and is located in a readily identifiable position with respect to the door in the event that the occupant needs to utilize the key in an emergency situation. While not limited to any specific location with respect to the door, the preferred location for the key case is on one of the conventional hinges, preferably the lower hinge of the two or three hinge connection between a door and a door casing. The location of such a hinge is readily apparent to an occupant of the premises and can be easily found without the use of any light. More importantly, it is readily accessible in those situations where a fire causes heavy smoke requiring the occupant to remain along the floor of the room, and, as mentioned previously hereinabove, cannot be reached by an intruder such as a burglar where entry is attempted by breaking a glass panel in the door.

Figure 2:
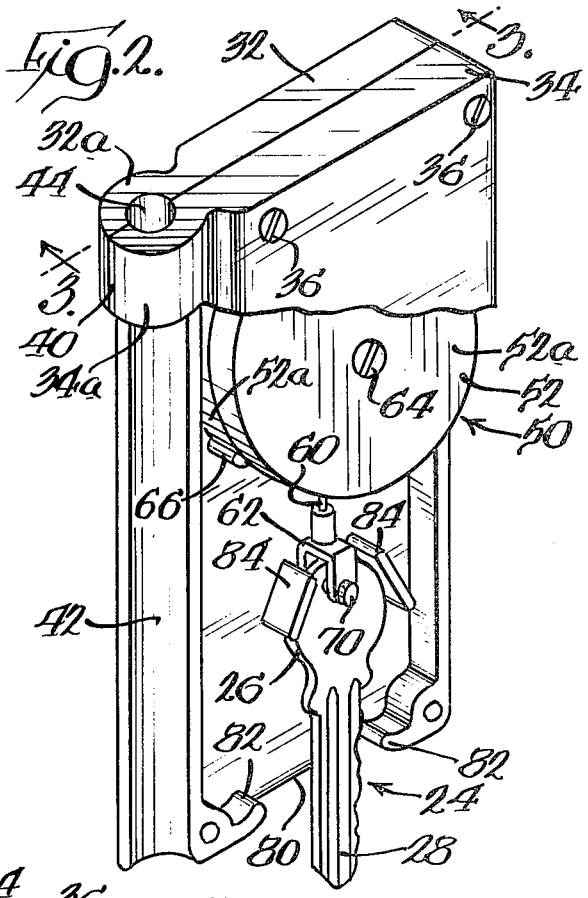
FIG. 2 is a perspective view of said embodiment of the key case with portions thereof broken away for purposes of clarity; and, FIG. 3 is a sectional view in elevation of said embodiment of the case, as viewed along line 3—3 of FIG. 2.
Figure 3:
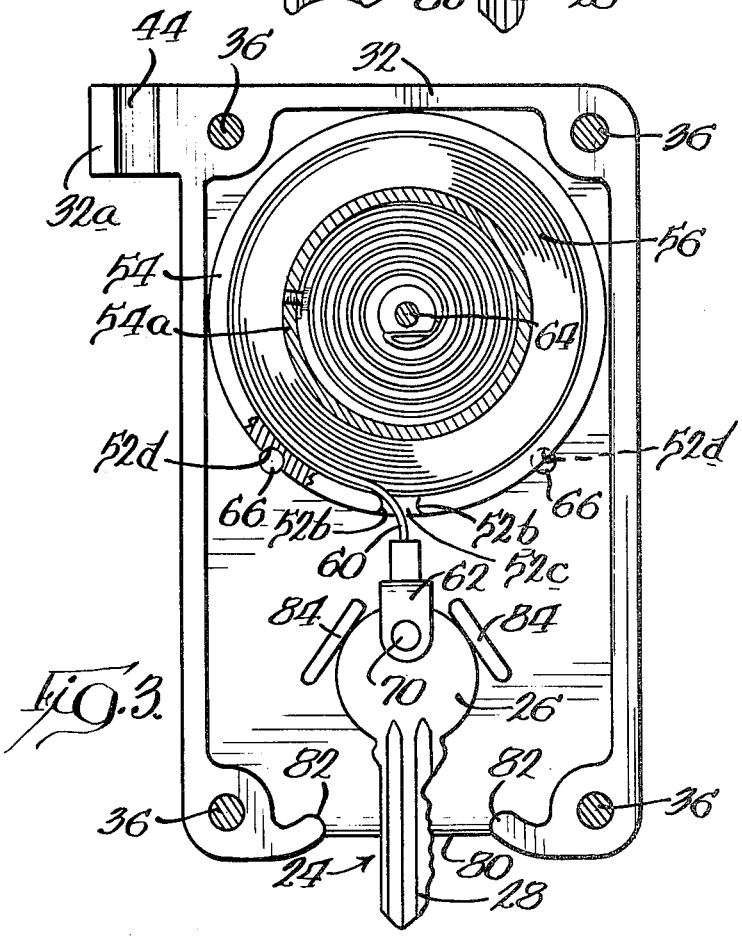

As best shown in FIGS. 2 and 3 of the drawings, the key case of the present invention, identified generally by reference numeral 30, includings a housing defined by first and second portions 32 and 34 interconnected by suitable fastening means, such as screws 36 adjacent the respective four corners thereof. Instead of using screws, the portions 32 and 34 can be provided with interlocking female and male members (not shown) to enable the portions 32 and 34 to be snapped into engagement with one another. The case 30 has a sleeve 40, formed by outwardly extending arcuate portions 32*a* and 34*a*, respectively, provided at the upper inner margin of the portions 32 and 34 of the housing of the key case 30, adjacent one end of one edge 42 of the case 30. The sleeve 40 has an opening 44 having a diameter substantially equal to the diameter of the hinge pin 20. The remainder of inner lateral edge 42 has a configuration conforming generally to the rounded, peripheral configuration of the interleaved hinge portions 18 of the hinge 12 (see FIG. 1). More specifically, the inner edge 42 has a generally arcuate inner surface 46 which has a radius that is equal to the rounded peripheral surfaces of the interleaved portions 18. Thus, the case can readily be attached to a conventional hinge of a door by removing the pin 20 of lower hinge 12 and either inserting a pin of greater axial length or the same pin through the opening 44 in sleeve 40. The case 30 is, therefore, in a readily identifiable place with respect to the door 10 and close to the floor.

The internal construction of the case is illustrated in FIGS. 2 and 3 of the drawings. The case 30 defines a generally rectangular internal open area in which a retracting mechanism 50 is supported. The retracting mechanism 50, as shown, comprises a housing 52, desirably formed of a pair of cup-shaped portions 52*a*-52*-a*. The housing 52 contains a reel 54 having a hub 54*a* in which a coiled tension-spring 56 is mounted. One end of the spring 56 is secured to the reel 54, while the other end is received in a notched pin (not shown) carried on one of the portions 52*a* of the housing 52. A flexible member 60, which may be a chain, cable, wire or cord, advantageously fabricated of a non-flammable, heat-resistant material, is wound on the reel 54. One end of the member 60 is attached to key holding means such as yoke 62. Ideally, the member 60 should be from about five to six feet in length to enable it to easily reach the lock on a door.

The portions 52*a*—52*a* of the housing 52 of the retracting mechanism 50 may be secured to one another by a screw 64, as shown, or the portions 52*a*—52*a* can be formed with a tongue and groove arrangement (not shown) whereby they can be snapped into engagement with one another. Each portion 52*a*—52*a* is provided with an opposed recess 52*b* which together form an opening 52*c* through which the free end of the member 60 extends. The housing 52 is prevented from rotating with relation to the case 30 by providing at least one of the portions 52*a*—52*a* thereof with a pair of spaced recesses 52*d*—52*d* for receiving inwardly-extending pins 66—66 formed integrally on the inner wall of the portion 32 of the case 30.

The yoke 62 is adapted to extend across opposite sides of the head 26 of the key 24, and is pivotally attached to the head 26 through a pin 70.

The cooperating halves 32 and 34 of the case 30 define a generally restangular opening 80 at the lower end thereof which is surrounded by inwardly-extending guide surfaces 82. The opening 80 is dimensioned to be substantially equal to and slightly larger than the head 26 of key 24 to guide the key 24 to a stored position as illustrated in FIG. 3. The stored position illustrated in FIG. 3 is preferably defined by two angularly related spaced lugs 84—84 which are spaced from each other a distance that is less than the transverse dimension of the head 26 of key 24, and the lugs 84 are spaced from the opening 80 by a dimension which is less than the length of the key 24 so that the end of the shank 28 of the key 24 extends downwardly and outwardly with relation to the opening 80 in the bottom of the case 30.

The installation and operation of the unique key case constructed in accordance with the present invention is apparent from the above description, but will be briefly summarized at this point. The conventional door hinge 12 with its pin 20 utilized for attaching door 10 to case 14 is available in virtually all residences and is conveniently utilized for attaching the case 30 thereto by removal of pin 20 and alignment of sleeve 40 with hinge portions 18 and reinsertion of pin 20. As stated, a longer pin can be used, if necessary, to accommodate the additional axial length of sleeve 40. In its installed position, the arcuate inner surface 46 is in juxtaposed relation and preferably in contacting engagement with the peripheral surface of the rounded hinge portions 18 of hinge 12. The retracting mechanism 50, which includes the tension-spring 56, enables the flexible member 60 on the reel 54 to be unwound until the user is able to reach and operate the lock tumbler 22 of the lock on the door. When the key 24 is released, for whatever reason, it will automatically be retracted by the mechanism 50 to its stored position as illustrated in FIG. 3.

Whenever the key 24 is needed for unlocking lock 22, the occupant thereof, knowing the location of case 30, can grip the exposed portion 28 of key 24 and provide a pulling force to move the key from the case to lock 22 to unlock the door during an emergency situation. In the event that the key is released for any reason, the key will automatically be returned to its stored position adjacent the hinge so that the occupant will know exactly where to reach to grasp the key for again attempting to unlock the door. In those instances where it is preferred to wall mount the key case by means of a screw, for example, using a knockout hole (not shown) in one or both of the portions 32 and 34 of the key case, the key, again, will always be in a known, permanent position in relation to the door lock 22, and will automatically be returned to its stored position when released.

As can be appreciated from the above description, the present invention provides an extremely simple, inexpensive safe mechanism which can be incorporated into most any existing door structure without any modification thereof. The key case provides a readily accessible storage space for a key that is needed to unlock a door in the event of an emergency situation, such as fire, wherein a large amount of smoke may be present.

It will be apparent to those skilled in the art that a number of modifications can be made in the preferred embodiment of the key case described without departing from the scope of the invention. For example, the case 30 need not necessarily be attached to the hinge itself, or to a wall, but could be attached to a bracket on the door or the door frame. In addition, rather than having the separate stop means in the form of lugs 84, yoke 62 could act as a stop member engaging the walls of housing 52 of the mechanism 50. It is intended, therefore, that the scope of the invention only be limited by the appended Claims.

We claim:

1. In combination with a door attached to a door frame by hinge means having a removable pin and including a lock on said door having a lock cylinder for receiving a key for operating said lock cylinder, a key case having a sleeve adapted to be aligned with the hinge means of the door and to receive said removable pin for securement to said hinge means, a retracting mechanism in said key case including a flexible member having a length at least as great as the spacing between said hinge means and said lock cylinder attached at the free end of the flexible member, an opening in the key case for admitting the key, and stop means within the key case defining a stored position for said key whereby a portion of the key extends outwardly through the opening in the key case, said portion of the key being adapted to be gripped in an emergency situation and moved to said lock cylinder to operate it and said retracting mechanism being adapted to return said key to its stored position when released or dropped.

2. The combination as defined in claim 1 in which said hinge means includes interleaved hinge portions with said pin extending through said hinge portions, said sleeve being positioned adjacent one end of one edge of said key case, said one edge having a conforming configuration with a periphery of said hinge portions and being in juxtaposed relation thereto.

3. The combination as defined in claim 1 in which said key has a head portion and said key case has lugs spaced from each other by a dimension less than the width of the head of said key and spaced from said opening by a dimension less than the length of said key to define a stop which defines said stored position for said key.

4. In a door attached to a casing by hinge means and having a lock operable with a key having a head portion and a shank portion, the improvement comprising: a key case for a key for said lock attached at a fixed location spaced from said lock, a spring operated retracting mechanism in said key case including a flexible member with said key connected to an end thereof, said flexible member having a length at least equal to the spacing between said fixed location and said lock, and an opening in said key case defined by inwardly extending guide surfaces at the base of the key case for guiding said key to a stored position in the key case wherein only the end of the shank portion of said key is exposed outside said opening for gripping to enable the key to be moved to said lock, said retracting mechanism returning said key to said stored position upon being released or dropped so that said key is readily locatable at said fixed location in emergency situations.

5. In a door arrangement as claimed in claim 4, stop means provided in said key case, said stop means being positioned inwardly of said opening for engaging the head of said key when the key is retracted to its stored position.

* * * * *